US010900501B2

(12) United States Patent
Trieb

(10) Patent No.: US 10,900,501 B2
(45) Date of Patent: Jan. 26, 2021

(54) HYDRAULIC PRESSURE BOOSTER AND METHOD FOR THE PRODUCTION OF AN AXIAL COMPRESSIVE STRESS IN A HIGH-PRESSURE CYLINDER

(71) Applicant: BFT GmbH, Hoenigsberg (AT)

(72) Inventor: Franz Trieb, Kapfenberg (AT)

(73) Assignee: BFT GMBH, Hönigsberg (AT)

( * ) Notice: Subject to any disclaimer, the term of this patent is extended or adjusted under 35 U.S.C. 154(b) by 0 days.

(21) Appl. No.: 16/597,561

(22) Filed: Oct. 9, 2019

(65) Prior Publication Data

US 2020/0116166 A1 Apr. 16, 2020

(30) Foreign Application Priority Data

Oct. 10, 2018 (AT) ..... 50882/2018

(51) Int. Cl.
*F15B 3/00* (2006.01)
*F15B 15/14* (2006.01)

(52) U.S. Cl.
CPC ..... *F15B 3/00* (2013.01); *F15B 15/1428* (2013.01); *F15B 15/1452* (2013.01); *F15B 15/1461* (2013.01)

(58) Field of Classification Search
CPC ..... F15B 3/00; F04B 9/105; F04B 9/1056; F04B 9/113; F04B 9/117; F04B 9/1172; F04B 53/168
See application file for complete search history.

(56) References Cited

U.S. PATENT DOCUMENTS 3,114,326 A 12/1963 Yaindl
3,602,613 A * 8/1971 Gunther ..... F04B 53/164 417/437

(Continued)

FOREIGN PATENT DOCUMENTS

CN 206 309 544 7/2017
DE 2949083 7/1980

(Continued)

OTHER PUBLICATIONS

Austria Office Action conducted in counterpart Austria Appln. No. A 50882/2018 (dated Jul. 4, 2019) (w/ machine translation).

(Continued)

*Primary Examiner* — Michael Leslie
(74) *Attorney, Agent, or Firm* — Greenblum & Bernstein, P.L.C.

(57) ABSTRACT

Hydraulic pressure booster and method includes a low-pressure segment including a hydraulic cylinder and a hydraulic piston, which is displaceable in both axial directions of the hydraulic cylinder and opposing high-pressure segments located on each axial end of the low pressure segment. Each high-pressure segment includes a plunger piston movable in a high-pressure cylinder via the hydraulic piston. Each high-pressure cylinder is arranged in a clamping sleeve, both of which are positioned between the hydraulic cylinder and a valve body. For each high-pressure segment, a clamping piston, which includes a pressure surface applying pressure to the high pressure cylinder and a high pressure seal for the plunger piston and a pressure surface on which pressure from the hydraulic piston is applied, is axially displaceable in the hydraulic cylinder so that the high-pressure cylinder is in compressive contact with the hydraulic cylinder and the valve body.

20 Claims, 1 Drawing Sheet

(56) References Cited

U.S. PATENT DOCUMENTS

| | | | | |
|---|---|---|---|---|
| 4,818,194 | A * | 4/1989 | Saurwein | F04B 53/109 137/512.5 |
| 5,092,744 | A * | 3/1992 | Boers | F04B 9/105 137/533.21 |
| 9,429,019 | B2 * | 8/2016 | Stuehlinger | F04B 37/12 |
| 2012/0063939 | A1 | 3/2012 | Mann | |

FOREIGN PATENT DOCUMENTS

| | | |
|---|---|---|
| DE | 3027878 | 2/1982 |
| DE | 19722493 | 12/1998 |
| EP | 2 636 901 | 9/2013 |
| WO | 2012/051635 | 4/2012 |

OTHER PUBLICATIONS

Europe Office Action conducted in counterpart Europe Appln. No. EP 19196149 (dated Mar. 13, 2020).

* cited by examiner

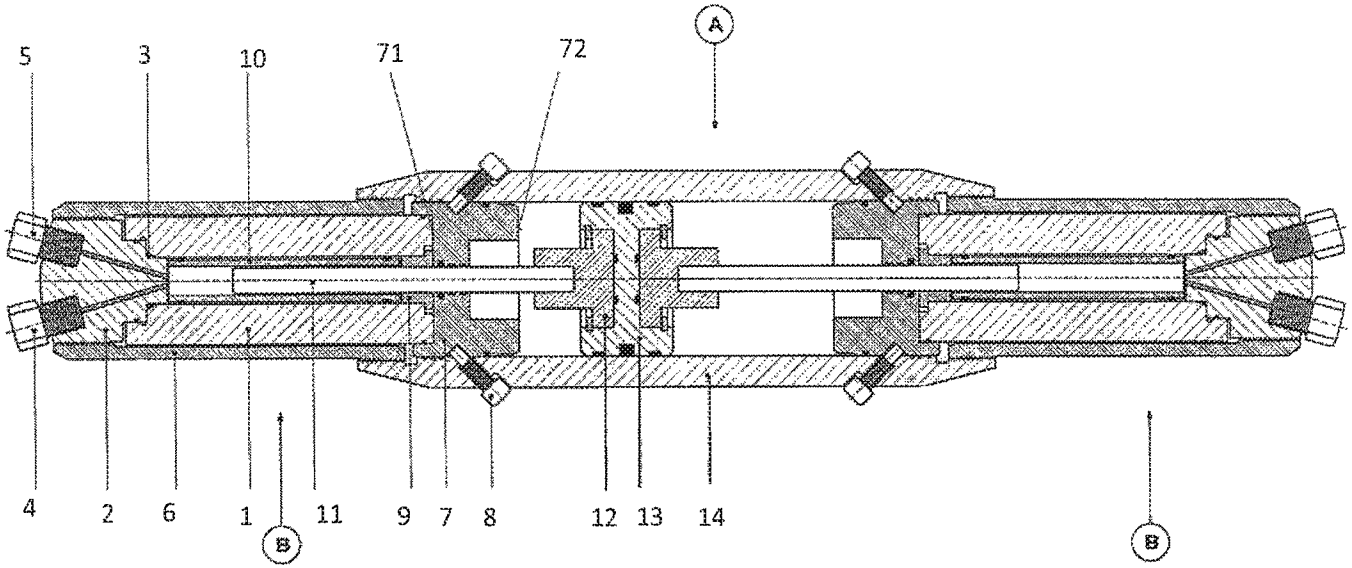
A
B
B
14
13
12
8
7
9
11
1
6
2
4
72
71
10
3
5

HYDRAULIC PRESSURE BOOSTER AND METHOD FOR THE PRODUCTION OF AN AXIAL COMPRESSIVE STRESS IN A HIGH-PRESSURE CYLINDER

CROSS-REFERENCE TO RELATED APPLICATIONS

The present application claims priority under 35 U.S.C. § 119 of Austrian Patent Application No. A 50882/2018, filed Oct. 10, 2018, the disclosure of which is expressly incorporated by reference herein in its entirety.

BACKGROUND

1. Field of the Invention

Embodiments of the invention relate to a hydraulic pressure booster comprised essentially of a low-pressure segment containing a hydraulic piston which can be displaced in both axial directions, controlled by a working fluid, in a hydraulic cylinder and an opposing high-pressure segment on both sides which respectively comprises a plunger piston that can be moved by the hydraulic piston in a high-pressure cylinder which is in compressive contact with the hydraulic cylinder on the one side and on the other side with a valve body with the use of sealing systems.

Pressure boosters of this type are being used to an increasing extent, for example, in water jet cutting devices, and, due to the high pressure in the high-pressure segment, place special demands on the mechanical properties of the components and the sealing systems used in terms of the service life thereof.

2. Discussion of Background Information

The most widely varying sealing systems are known for an actuated high-pressure piston rod in a high-pressure cylinder and for high-pressure cylinders in the valve body or sealing head, which systems are aimed at a long service life and low service costs.

A high-pressure assembly of a hydraulic pressure booster in any case requires constant compressive stresses in the seal regions. To this end, proposals are known for arranging puller bolts between the valve body and the working or low-pressure cylinder and in this manner producing compressive stresses in the sealing systems with plunger pistons. However, due to the prestressing forces required, a special hydraulic prestressing device may be necessary in the toolkit.

SUMMARY

Embodiments of the invention are directed to a hydraulic pressure booster of the type named at the outset which overcomes the disadvantages of the prior art, and which in a simple manner enables a constant compressive prestress in the seal regions and permits separate service and/or replacement work on components in the respective high-pressure segments.

Furthermore, embodiments are provided to specify a new method for the production of an axial compressive stress in a high-pressure cylinder of a hydraulic pressure booster, which ensures a uniform pressing of the pressure surfaces against one another in the seal regions of high-pressure segments with the desired prestress and with little effort.

The aforementioned embodiments include that the respective high-pressure cylinder is arranged in a clamping sleeve which is detachably connected to the hydraulic cylinder on the one side and to a valve body on the other side, and in that one clamping piston is axially displaceable in the hydraulic cylinder for each high-pressure cylinder and can be fixed by a pressing device, and in that the clamping piston comprises on the one side pressure surfaces for the frontal application of pressure to the high-pressure cylinder with a high-pressure seal for the plunger piston and on the other side comprises pressure surfaces for an application of pressure by the hydraulic piston.

The advantages obtained with a pressure booster according to the invention are, among other things, that the valve body and the hydraulic cylinder are each connected in a detachable manner, that is, such that service work is facilitated, by a clamping sleeve, and that a clamping piston is arranged in front of the hydraulic piston in the hydraulic cylinder.

After a simple assembly of the components of a high-pressure segment, the hydraulic piston and the radial pressure surfaces thereof can be positioned against the radial pressure surfaces of the clamping piston through an introduction of a working fluid into the opposing space of the hydraulic cylinder.

A simple further increase in the pressure of the working fluid causes a displacement of the clamping piston in an axial direction and a buildup of compressive force on the front face of the high-pressure cylinder with the high-pressure seal.

Since a valve body and the hydraulic cylinder are now connected by a clamping sleeve, and since the clamping piston presses on a front face of the high-pressure cylinder, an effective high-pressure seal forms on the bearing ring in the valve body on the opposite side.

However, during heavy operation of a hydraulic pressure booster, a high-pressure seal is only effective when there is a sufficiently large mechanical prestress or a similarly constant axial compressive stress in the high-pressure cylinder.

With a hydraulic pressure booster according to embodiments of the invention, a setting of the amount of constant compressive stress in the high-pressure cylinder is achieved in that the pressure of the working fluid is increased past the rated value, in that the clamping piston thus acts with increased compressive force on the high-pressure cylinder, and in that an axial fixing of the clamping piston takes place in this position by a tensioning device.

It is thus possible to separately set each high-pressure segment in a simple manner, whereby short service times are required and no separate clamping apparatus is necessary.

The valve body having a suction valve and a pressure valve, as is known per se, comprises, as briefly illustrated above, a sealing system for the high-pressure cylinder, for example, a deformable metallic bearing ring, that is constantly active as a result of a compressive prestress.

According to one embodiment of the invention, it is advantageous if the clamping piston can be fixed in an axial position in the hydraulic cylinder against compressive forces from the high-pressure cylinder using tensioning screws. Thus, a uniform fixing of the clamping piston in the hydraulic cylinder can take place in a simple manner after the compressive force has been set for the high-pressure cylinder through an application of working fluid to the hydraulic piston with a pressure that is 30% higher than the rated value, for example.

Beneficially, the plunger or high-pressure piston rod is fixed in a shrink sleeve that is connected to the hydraulic piston. Through this design of the connection, a high coupling reliability is achieved in continuous operation.

Embodiments of the invention are directed to a method for the production of an axial compressive stress in a high-pressure cylinder of a hydraulic pressure booster is achieved in that, when at least one of the valves in the valve body is open, the hydraulic piston is positioned against the clamping piston in an axial direction by a working fluid and an increase in pressure in the working fluid to a value above the working pressure of the pressure booster is carried out, which causes a pressing of the clamping piston against the front face of the high-pressure cylinder and the front face of the high-pressure seal of the plunger piston rod, wherein an opposing compressive force forms as a result on the bearing ring of the valve body on the opposite front face of the high-pressure cylinder, which forces cause axial compressive stresses in the high-pressure cylinder, after which the clamping piston is fixed by tensioning means and the axial compressive stresses in the high-pressure cylinder are maintained.

The advantages obtained with the method according to embodiments of the invention can essentially be seen in that, by an increase in the pressure of a working fluid, a uniform pressing against one another by the pressure surfaces of the hydraulic piston and the clamping piston occurs and, furthermore, a compressive effect occurs on the front face of the high-pressure cylinder and on the bearing ring. Thus, a constant high-pressure sealing effect can be achieved when the pressure in the working fluid is increased beyond the working pressure.

A compressive stress thereby built up in the high-pressure cylinder is, according to the method, maintained by a fixing of the clamping piston in the hydraulic piston.

Embodiments are directed to a hydraulic pressure booster that includes a low-pressure segment including a hydraulic cylinder and a hydraulic piston, which is controlled by a working fluid to be displaceable in both axial directions of the hydraulic cylinder and an opposing high-pressure segment located on each axial end of the low pressure segment, wherein each opposing high-pressure segment includes a plunger piston movable in a high-pressure cylinder via the hydraulic piston. Each high-pressure cylinder is positioned between the hydraulic cylinder and a valve body and is arranged in a clamping sleeve that is positioned between the hydraulic cylinder and the valve body. For each opposing high-pressure segment, a clamping piston, which includes a first pressure surface for applying pressure to the high pressure cylinder and a high pressure seal for the plunger piston and a second pressure surface on which pressure from the hydraulic piston is applied, is axially displaceable in the hydraulic cylinder so that the high-pressure cylinder is in compressive contact with the hydraulic cylinder and the valve body.

In accordance with other embodiments, at least one of: each high-pressure segment can include a high pressure seal that is compressibly positioned between the high-pressure cylinder and the clamping piston, or each high-pressure segment can include a bearing ring positioned to produce a continuous sealing effect against the valve body when the high-pressure cylinder is in compressive contact with the hydraulic cylinder and valve body. Further, the valve body may include a suction valve and a pressure valve, both of which can be connectable to an interior region of the high-pressure cylinder and to at least one of the high pressure seal or the bearing ring.

According to still other embodiments, the hydraulic pressure booster can further include mechanical connectors to positionally fix each clamping piston to retain the high-pressure cylinder in compressive contact with the hydraulic cylinder and valve body. Further, the mechanical connectors may include tensioning screws to axially positionally fix each clamping piston.

In other embodiments, each high-pressure segment can include a shrink bushing that is connected to the hydraulic piston and in which the plunger piston is located.

According to still other embodiments, a method for the production of an axial compressive stress in a high-pressure cylinder of the above-described hydraulic pressure booster includes opening at least one of the valves in the valve body, whereby a working fluid positions the hydraulic piston against the clamping piston in an axial direction; increasing a pressure of the working fluid to a value above a working pressure of the hydraulic pressure booster, whereby the clamping piston is pressed against a front face of the high-pressure cylinder and a front face of a high-pressure seal of the plunger piston, which results in an opposing compressive force on a bearing ring of the valve body via an opposite face of the high-pressure cylinder and in an axial compressive stress in the high-pressure cylinder; and while maintaining the axial compressive stress in the high-pressure cylinder, positionally fixing the clamping piston in the hydraulic cylinder to retain the axial compressive stress in the high-pressure cylinder between the hydraulic cylinder and valve body.

In other embodiments, the clamping piston may be positionally fixed by mechanical connectors. Further, the mechanical connectors can include tensioning screws.

Embodiments are directed to a method for setting up a hydraulic pressure booster for use. The hydraulic pressure booster includes a low-pressure segment including a hydraulic cylinder and a hydraulic piston, which is controlled by a working fluid to be displaceable in both axial directions of the hydraulic cylinder, and a first high-pressure segment, which includes a first high-pressure cylinder, is located on a first axial end of the low pressure segment and a second high-pressure segment, which includes a second high-pressure cylinder, is located on a second axial end of the low pressure segment. The method includes moving the hydraulic piston in a first axial direction to axially move a first clamping piston in the hydraulic cylinder to exert a compressive stress in the first high-pressure cylinder; and positionally fixing the first clamping piston in the hydraulic cylinder to retain the compressive stress in the first high-pressure cylinder.

According to embodiments, the method can further include moving the hydraulic piston in a second axial direction, which is opposite the first axial direction, to axially move a second clamping piston in the hydraulic cylinder to exert a compressive stress in a second high-pressure cylinder; and positionally fixing the second clamping piston in the hydraulic cylinder to retain the compressive stress in the second high-pressure cylinder.

In accordance with other embodiments, the first clamping piston can be positionally fixed by mechanical connectors. Further, the mechanical connectors may include tensioning screws.

In accordance with still yet other embodiments, at least one of: the first high-pressure segment further includes a first plunger piston and a first high pressure seal, arranged so that the first high pressure seal is compressibly positioned between the first high-pressure cylinder and the first clamping piston, or the first high-pressure segment further includes a first valve body and a first bearing ring, arranged so that the first bearing ring produces a continuous sealing effect against the valve body when the compressive stress is exerted on the first high-pressure cylinder. Further, the first valve body can include a first suction valve and a first pressure valve, both of which can be connectable to an interior region of the first high-pressure cylinder and to the at least one of the first high pressure seal or the first bearing ring.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

The FIGURE shows a hydraulic pressure booster.

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In the FIGURE, a hydraulic pressure booster according to the invention is illustrated, comprising a low-pressure segment A with a double-acting piston 13 in a hydraulic cylinder 14 and one high-pressure segment B, B' each on both sides.

Because the high-pressure segments are identical, only the high-pressure segment shown in the left part of the FIGURE will be discussed in the explanations.

In the hydraulic cylinder 14 of the low-pressure segment A, a piston 13 is arranged that can be moved in both axial directions, controlled by a working fluid.

The hydraulic cylinder 14 and a valve body 2 are detachably connected by a clamping sleeve 6, wherein a high-pressure cylinder 1 with a compensation bushing 10 and a plunger or a high-pressure piston rod 11 are located in the clamping sleeve 6, which high-pressure piston rod 11 protrudes through a clamping piston 7 and is fixed in the hydraulic piston 13 by a shrink bushing 12.

During the production of an axial compressive stress in the high-pressure cylinder, a working fluid (not illustrated) is introduced into the hydraulic cylinder 14 in the section facing away from the high-pressure segment B and the hydraulic piston 13 with the frontal pressure surface thereof is positioned against the pressure surface 72 of the clamping piston 7 and, if the mechanical connectors or fixing elements 8, such as tension screws, are open, is axially displaced. As a result, the pressure surface 71 of the clamping piston 7 and the front face of the high-pressure cylinder 1 come into contact with a high-pressure seal 9.

An increase of the pressure in the working fluid moves the piston 13 and the clamping piston 7 further against the high-pressure cylinder 1 and transfers to the high-pressure cylinder 1 a compressive prestress which activates the high-pressure seal 9 in the direction of the high-pressure piston rod 11 and activates a seal through a deformation of the bearing ring 3 in the valve body 2. Valve body 2 can include a suction valve (or inlet valve) 4 and a pressure valve (or outlet valve) 5 for applying pressure in high pressure cylinder 1 to plunger or a high-pressure piston rod 11.

The pressure of the working fluid in the hydraulic cylinder 14 is subsequently set to a value above the designated working pressure, in order to ensure a constant prestress in the high-pressure cylinder 11 and thus a continuous sealing effect of the bearing ring 3 against the valve body 2. In embodiments, the pressure value above the designated working pressure that is applied to the clamping piston 7 for compressively stressing the high pressure cylinder and valve body 2 can be about 30 MPa.

An axial position of the clamping piston 7 reached in such a manner is stabilized by mechanical connectors or fixing elements 8, such as tensioning screws, from the hydraulic cylinder 14, and this positioning is maintained during continuous operation of the pressure booster.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The following list of reference numerals is intended to provide easier association of the parts and components.

A Low-pressure segment
B, B' High-pressure segments
1 High-pressure cylinder
2 Valve body
3 Bearing ring
4 Suction valve (inlet valve)
Pressure valve (outlet valve)
6 Clamping sleeve
7 Clamping piston
71 Pressure surface facing the high-pressure cylinder
72 Pressure surface facing the hydraulic piston
8 Mechanical connector, e.g., tensioning screw
9 High-pressure seal
Compensation bushing
11 Plunger (high-pressure piston rod)
12 Shrink bushing
13 Hydraulic piston
14 Hydraulic cylinder

What is claimed:

1. A hydraulic pressure booster comprising:

a low-pressure segment including a hydraulic cylinder and a hydraulic piston, which is controlled by a working fluid to be displaceable in both axial directions of the hydraulic cylinder;

an opposing high-pressure segment located on each axial end of the low pressure segment, wherein each opposing high-pressure segment includes a plunger piston movable in a high-pressure cylinder via the hydraulic piston, wherein each high-pressure cylinder is positioned between the hydraulic cylinder and a valve body and is arranged in a clamping sleeve that is positioned between the hydraulic cylinder and the valve body, and wherein, for each opposing high-pressure segment, a clamping piston, which comprises a first pressure surface for applying pressure to the high pressure cylinder and to a high pressure seal for the plunger piston, and a second pressure surface on which pressure from the hydraulic piston is applied, is axially displaceable in the hydraulic cylinder to transfer a compressive prestress to the high-pressure cylinder, and is positionally fixable to maintain the compressive prestress in the hydraulic cylinder.

2. The hydraulic pressure booster according to claim 1, wherein at least one of:

each high-pressure segment includes the high pressure seal that is compressibly positioned between the high-pressure cylinder and the clamping piston, or each high-pressure segment includes a bearing ring positioned to produce a continuous sealing effect against the valve body when the high-pressure cylinder is in compressive contact with the hydraulic cylinder and valve body.

3. The hydraulic pressure booster according to claim 2, wherein the valve body comprises a suction valve and a pressure valve, both of which are connectable to an interior region of the high-pressure cylinder and to at least one of the high pressure seal or the bearing ring.

4. The hydraulic pressure booster according to claim 1, further comprising mechanical connectors to positionally fix each clamping piston to retain the high-pressure cylinder in compressive contact with the hydraulic cylinder and valve body.

5. The hydraulic pressure booster according to claim 4, wherein the mechanical connectors comprise tensioning screws to axially positionally fix each clamping piston.

6. The hydraulic pressure booster according to claim 1, wherein each high-pressure segment comprises a shrink bushing that is connected to the hydraulic piston and in which the plunger piston is located.

7. The hydraulic pressure booster according to claim 1, wherein the clamping piston further comprises fixing elements or mechanical connectors configured to positionally fix the clamping piston to maintain the compressive prestress in the hydraulic cylinder.

8. The hydraulic pressure booster according to claim 1, wherein the valve body comprises a bearing ring, which is deformable through the compressive prestress of the high pressure cylinder to activate a sealing function.

9. The hydraulic pressure booster according to claim 1, wherein the compressive prestress transferred to the high pressure cylinder via the clamping piston is about 30 MPa.

10. The hydraulic pressure booster according to claim 1, wherein the clamping cylinder is configured to additionally compressively prestress the valve body when compressively prestressing the high pressure cylinder.

11. A method for the production of an axial compressive stress in a high-pressure cylinder of a hydraulic pressure booster that includes a low-pressure segment including a hydraulic cylinder and a hydraulic piston, which is controlled by a working fluid to be displaceable in both axial directions of the hydraulic cylinder, an opposing high-pressure segment located on each axial end of the low pressure segment, in which each opposing high-pressure segment includes a plunger piston movable in a high-pressure cylinder via the hydraulic piston, in which each high-pressure cylinder is positioned between the hydraulic cylinder and a valve body and is arranged in a clamping sleeve that is positioned between the hydraulic cylinder and the valve body, in which, for each opposing high-pressure segment, a clamping piston, and which has a first pressure surface for applying pressure to the high pressure cylinder and to a high pressure seal for the plunger piston and a second pressure surface on which pressure from the hydraulic piston is applied, is axially displaceable in the hydraulic cylinder so that the high-pressure cylinder is in compressive contact with the hydraulic cylinder and the valve body, the method comprising:

opening at least one valve in the valve body, whereby a working fluid positions the hydraulic piston against the clamping piston in an axial direction;

increasing a pressure of the working fluid to a value above a working pressure of the hydraulic pressure booster, whereby the clamping piston is pressed against a front face of the high-pressure cylinder and a front face of the high-pressure seal of the plunger piston, which results in an opposing compressive force on a bearing ring of the valve body via an opposite face of the high-pressure cylinder and in an axial compressive stress in the high-pressure cylinder; and while maintaining the axial compressive stress in the high-pressure cylinder, positionally fixing the clamping piston in the hydraulic cylinder to retain the axial compressive stress in the high-pressure cylinder between the hydraulic cylinder and valve body.

12. The method according to claim 11, wherein the clamping piston is positionally fixed by mechanical connectors.

13. The method according to claim 12, wherein the mechanical connectors comprise tensioning screws.

14. The method according to claim 11, wherein the at least one valve in the valve body comprises at least one of a suction valve and a pressure valve.

15. A method for setting up a hydraulic pressure booster for use, the hydraulic pressure booster including a low-pressure segment including a hydraulic cylinder and a hydraulic piston, which is controlled by a working fluid to be displaceable in both axial directions of the hydraulic cylinder, and a first high-pressure segment, which includes a first high-pressure cylinder, is located on a first axial end of the low pressure segment and a second high-pressure segment, which includes a second high-pressure cylinder, is located on a second axial end of the low pressure segment, the method comprising:

moving the hydraulic piston in a first axial direction to axially move a first clamping piston in the hydraulic cylinder to exert a compressive stress in the first high-pressure cylinder; and positionally fixing the first clamping piston in the hydraulic cylinder to retain the compressive stress in the first high-pressure cylinder.

16. The method according to claim 15, further comprising:

moving the hydraulic piston in a second axial direction, which is opposite the first axial direction, to axially move a second clamping piston in the hydraulic cylinder to exert a compressive stress in a second high-pressure cylinder; and positionally fixing the second clamping piston in the hydraulic cylinder to retain the compressive stress in the second high-pressure cylinder.

17. The method according to claim 15, wherein the first clamping piston is positionally fixed by mechanical connectors.

18. The method according to claim 17, wherein the mechanical connectors comprise tensioning screws.

19. The method according to claim 15, wherein at least one of:

the first high-pressure segment further includes a first plunger piston and a first high pressure seal, arranged so that the first high pressure seal is compressibly positioned between the first high-pressure cylinder and the first clamping piston, or the first high-pressure segment further includes a first valve body and a first bearing ring, arranged so that the first bearing ring produces a continuous sealing effect against the valve body when the compressive stress is exerted on the first high-pressure cylinder.

20. The method according to claim 19, wherein the first valve body comprises a first suction valve and a first pressure valve, both of which are connectable to an interior region of the first high-pressure cylinder and to at least one of the first high pressure seal or the first bearing ring.

* * * * *